United States Patent [19]

Antipov et al.

[11] 4,350,213

[45] Sep. 21, 1982

[54] IMPACT WRENCH

[76] Inventors: Georgy A. Antipov, ulitsa Krasny Mayak, 3, kv. 146; Mikhail L. Gelfand, Yaroslavskoe shosse, 129, kv. 44, both of Moscow; Yakov I. Tsipenjuk, ulitsa Kirova, 6, kv. 30, Solntsevo Moskovskoi oblasti; Boris G. Goldshtein, ulitsa Molodogvardeiskaya, 24, korpus 1, kv. 26, Moscow; Nikolai S. Lavnikov, ulitsa Kustanaiskaya, 117, kv. 10, Rostov-na-Donu; Leonid N. Teres, ulitsa 2 Koltsevaya, 61/21, Rostov-na-Donu; Ivan I. Urazhdin, ulitsa Engelsa, 52/56, kv. 18, Rostov-na-Donu; Petr S. Yakubovsky, Podshipnikovy pereulok, 12, kv. 36, Rostov-na-Donu; Vitaly T. Boiko, ulitsa Jubileinaya, 13a, kv. 24, Ljubertsy Moskovskoi oblasti; Anatoly M. Kalmykov, ulitsa Artjukhinoi, 7/7, kv. 51, Moscow; Dmitry P. Minyashkin, ulitsa Junykh Lenintsev, 43/33, kv. 213, Moscow; Mikhail M. Stepanov, ulitsa Chistova, 13a, kv. 90, Moscow, all of U.S.S.R.

[21] Appl. No.: 86,285

[22] Filed: Oct. 19, 1979

[51] Int. Cl.[3] ..... B25B 21/02

[52] U.S. Cl. ..... 173/93.6

[58] Field of Search ..... 173/93.5, 93.6, 93

[56] References Cited

U.S. PATENT DOCUMENTS

| | | | |
|---|---|---|---|
| 3,804,180 | 4/1974 | Gelfand et al. | 173/93 X |
| 3,952,814 | 4/1976 | Gelfand et al. | 173/93 |
| 4,232,750 | 11/1980 | Antipov et al. | 173/93.6 |

*Primary Examiner*—Werner H. Schroeder
*Assistant Examiner*—Andrew M. Falik
*Attorney, Agent, or Firm*—Lilling & Greenspan

[57] ABSTRACT

An impact wrench comprising a drive shaft, an anvil with impact cams, a striker having a flywheel mass connected to the drive shaft and impact cams connected to the flywheel mass so as to rotate therewith and move axially in relation thereto. The impact wrench includes a device designed for preventing the striker impact cams from interaction with the anvil impact cams until the striker attains a pre-set rotational speed. According to the invention, the flywheel mass and the anvil are immobile axially, whereas the striker impact cams are adapted to move axially in relation to the striker flywheel mass during striker acceleration. The device for preventing interaction of the striker and anvil impact cams is made in the form of a movable abutment arranged to limit the axial movement of the striker impact cams and located between the striker impact cams and the anvil impact cams in such a manner that during acceleration of the striker flywheel mass the abutment is in engagement with the striker impact cams and moves therewith, limiting their axial movement and preventing them from interaction with the anvil impact cams, and disengages from the striker impact cams for said cams to move further and interact with the anvil impact cams after the abutment interacts with the anvil.

10 Claims, 15 Drawing Figures

IMPACT WRENCH

The present invention relates to impact wrenches employed in various industries for torque tightening of high-tensile screw joints.

Known in the art is an impact wrench comprising a drive shaft, an anvil having impact jaws and rigidly connected to a spindle, and a hammer having a flywheel mass connected to the drive shaft and impact jaws connected to the flywheel mass and designed to engage with the anvil impact jaws (see U.S. Pat. No. 3,144,109). The term "flywheel mass" is understood to mean a massive portion of the hammer which accumulates kinetic energy during rotation for the purpose of transmitting it through the hammer impact jaws to the anvil to do useful work. The hammer impact jaws are constructed in the form of flyweights and arranged to be brought into engagement with the anvil impact jaws by a centrifugal force.

Said impact wrench suffers from the disadvantage that the hammer impact jaws are brought into engagement with the anvil impact upon one or two revolutions of the drive shaft during the acceleration of the flywheel mass, due to which sufficient impact energy cannot be accumulated, causing low efficiency and high vibration in operation. Furthermore, torque tightening with such impact wrench is impossible because stable impact energy cannot be obtained.

The abovesaid disadvantages are eliminated in an impact wrench comprising a drive shaft, an anvil connected to a spindle for the purpose of rotating together therewith, a hammer having a flywheel mass connected to the drive shaft and impact jaws connected to the flywheel mass so as to rotate together therewith and move axially in relation thereto, and flyweights fitted in the flywheel mass for the purpose of bringing the hammer impact jaws into engagement with the anvil impact jaws after the hammer gains a pre-set rotational speed (see U.S. Pat. No. 3,952,814).

In the aforementioned impact wrench, the hammer impact jaws are made integral with the flyweights and prevented from axial movement during the acceleration of the hammer by an internal projection provided on the flywheel mass. During the acceleration of the hammer the flywheel mass is moved by the flyweights toward the anvil until the projections of the hammer impact jaws come into contact with the bevel surface on the anvil impact jaws. This engagement causes the hammer impact jaws to be disengaged from the flywheel mass and engaged with the anvil impact jaws.

The abovesaid impact wrench has high impact energy and low vibrations. However, it suffers from the disadvantage that it is not sufficiently dependable in operation and loses energy in moving the hammer flywheel mass before bringing the hammer impact jaws into engagement with the anvil impact jaws. Furthermore, a power spring has to be used between the flywheel and the housing with resultant increase of the tool size.

Also known in the art is an impact wrench comprising a drive shaft, an anvil having impact jaws and connected to a spindle for the purpose of rotating together therewith, a hammer having a flywheel mass connected to the drive shaft and impact jaws connected to the flywheel mass so as to rotate together therewith and move axially in relation thereto, and flyweights fitted in the flywheel mass for the purpose of bringing the hammer impact jaws into engagement with the anvil impact jaws after the hammer attains a certain rotational speed (see U.S.S.R. Inventor's Certificate No. 659373). In this impact wrench, the hammer flywheel mass also moves axially during acceleration. The hammer impact jaws are made integral with the flyweights and connected to the flywheel mass by means of a synchronizing sleeve located on the drive shaft between the hammer impact jaws and the flywheel mass. The synchronizing sleeve has a projection arranged to engage with the anvil for the purpose of turning the synchronizing sleeve and disengaging the hammer impact jaws from the flywheel mass. Until the sleeve is turned the hammer impact jaws do not move axially in relation to the flywheel mass and travel together therewith.

Apart from the abovesaid disadvantages associated with the need for moving the flywheel mass axially, the impact wrench under consideration is not sufficiently dependable in operation and is complicated from the manufacturing viewpoint.

U.S. Pat. No. 3,952,814 (FIG. 2) describes an impact wrench comprising a hammer flywheel mass which is stationary axially fixed. In this impact wrench, the hammer impact jaws are brought into engagement with the anvil impact jaws not by the direct action of flyweights, but through the use of a complicated mechanism comprising a jaw clutch and a cam mechanism with V-grooves and balls (see FIG. 40 of U.S. Pat. No. 3,952,814). The impact wrench has a complicated construction, the axial size of the tool is large and the wrench operating dependability is not sufficient.

It is an object of the present invention to provide an impact wrench having a reduced mass of axially moving parts.

It is a further object of the present invention to improve operating dependability of the impact wrench.

It is a still further object of the present invention to provide an impact wrench wherein all parts of the impact clutch are of simple construction.

It is a still further object of the present invention to provide an impact wrench of higher operating dependability.

These and other objects are achieved in an impact wrench comprising a drive shaft, an anvil having impact jaws and connected to a spindle for the purpose of rotating together therewith, a hammer having a flywheel mass connected to the drive shaft for the purpose of rotating together therewith and impact jaws connected to the flywheel mass so as to rotate together therewith and move axially in relation thereto, and flyweights fitted in the hammer flywheel mass for the purpose of moving the hammer impact jaws toward the anvil for said jaws to interact with the anvil impact jaws, and a device designed to prevent the impact jaws of the hammer from engagement with those of the anvil until the hammer attains a pre-set rotational speed.

According to the invention, the flywheel mass and the anvil are fixed axially, the hammer impact jaws are adapted to move axially in relation to the hammer flywheel mass during hammer acceleration, and the device for preventing engagement of the impact jaws of the hammer and anvil is constructed in the form of a movable abutment arranged to limit the axial movement of the hammer impact jaws and located between the hammer impact jaws and the anvil in such a manner that during acceleration of the hammer flywheel mass the abutment is in engagement with the hammer impact jaws and moves therewith, limiting their axial movement and preventing them from engagement with the anvil impact jaws, and disengages from the hammer impact jaws for said jaws to move further and engage with the anvil impact jaws after the abutment engages with the anvil or a part rigidly connected thereto.

This construction of the impact wrench materially decreases the mass of the axially movable parts during hammer acceleration, whereby less energy is expended in bringing the hammer into engagement with the anvil. Also, the length of the impact wrench is decreased since there is no need for a spring between the flywheel and the impact wrench housing.

It is desirable that the abutment be made in the form of a tiltable sleeve mounted on the drive shaft so that it can be tilted in the plane passing through the drive shaft axis and provided with a spring fitted between the tiltable sleeve and the anvil, said tiltable sleeve being adapted to rotate together with the hammer impact jaws.

This embodiment of the abutment is provided for simplifying the construction of the device and for preventing the impact jaws of the hammer and anvil from engagement until the hammer attains a pre-set rotational speed and also increases the dependability of the construction.

The tiltable sleeve may have at least one external radial projection located in the plane passing through the hammer impact jaws, the distance from the axis of the drive shaft to the outer edge of the projection on the tiltable sleeve being greater than the distance from the axis of the drive shaft to the inner edge of the hammer impact jaws.

The tiltable sleeve may have an end wall facing the anvil and is provided with an eccentric hole the diameter of which corresponds to the diameter of the drive shaft, said hole being eccentric in the plane passing through the external projection on the tiltable sleeve and said end wall being adapted to rest against a projection provided on the drive shaft.

This embodiment of the invention provides high operating dependability of the impact wrench and simplifies the construction thereof.

The impact wrench may have its hammer impact jaws made integral with flyweights interconnected by a guide sleeve mounted on the drive shaft and be provided with a return spring. It is desirable that said return spring be installed between the tiltable sleeve and the guide sleeve and be located inside the tiltable sleeve.

This constructional arrangement enables the length of the impact wrench to be materially decreased.

An embodiment of the impact wrench is possible wherein the hammer impact jaws are provided on the hammer driven portion and the flyweights are made in the form of balls arranged to engage with the bevel surface of the hammer driven portion, a return spring being fitted between the hammer flywheel mass and the hammer driven portion.

In this case the tiltable sleeve is installed at an angle to the axis of the drive shaft and provision is made of a tilting device designed to set the sleeve in a tilted position before the hammer flywheel mass accelerates. Said tilting device may be made in the form of a bevel surface provided on the drive shaft.

This construction materially simplifies manufacture of the impact wrench.

In the embodiment of the impact wrench wherein the impact jaws are made integral with flyweights interconnected by a guide sleeve mounted on the drive shaft and provision is made of a return spring, the abutment is made in the form of a rotatable sleeve, which is mounted on the driven shaft and is arranged to embrace the guide sleeve, and a spring installed between the rotatable sleeve and the anvil, the rotatable sleeve has an end cam provided on the end thereof facing the anvil and end projections provided on the opposite end, the guide sleeve has radial projections designed to engage with the end projections provided on the rotatable sleeve, the flywheel mass accommodates spring-loaded balls located opposite the end projections on the rotatable sleeve, the anvil has a projection designed to engage with the end cam provided on the rotatable sleeve, and the return spring is located between the rotatable sleeve and the guide sleeve. Such a construction of the impact wrench makes it possible to decrease the length thereof.

Now preferred embodiments of the invention will be described in detail with reference to the accompanying drawings in which.

Figure 4:
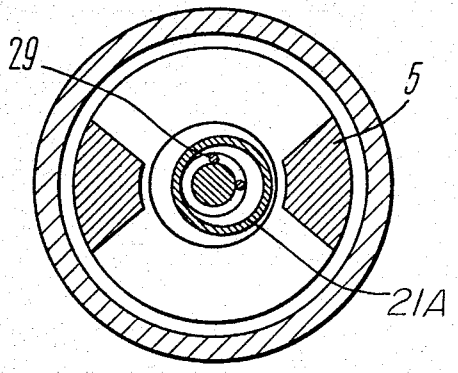
FIG. 4 is a section on the line IV—IV of FIG. 1.

The impact wrench (FIG. 1) comprises a housing 1 on which is journalled a spindle 2 having a square drive end 3 intended to receive a socket wrench (not shown). An anvil 4 with impact jaws 5 (FIGS. 1, 4) is made integral with the spindle 2 so that the anvil is axially fixed and rotates together with the spindle.

A drive shaft 6 is mounted in the impact wrench housing. One end of the drive shaft 6 is connected to a drive motor 7, for example, through an overload clutch 8. The other end of the drive shaft is fitted in a bore 9 provided in the spindle 2.

Figure 5:
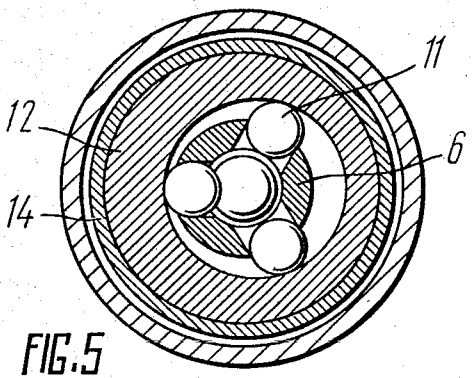
FIG. 5 is a section on the line V—V of FIG. 1.

The hammer comprises a flywheel mass 10 mounted on the drive shaft 6 and fixed axially by spring-loaded balls 11 incorporated in the overload clutch 8 (FIGS. 1, 5) and arranged to transmit torque from the drive shaft 6 to the flywheel mass 10. The construction of the ball-type overload clutch is described in detail in our concurrent patent application Ser. No. 867,580 which has matured into U.S. Pat. No. 4,191,264. With this construction, the flywheel mass 10 is axially fixed and can rotate together with the drive shaft 6.

The flywheel mass 10 is made in the form of a body 12 with a rectangular-section longitudinal recess 13

Figure 2:
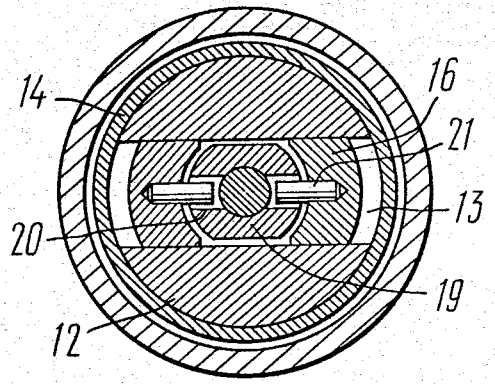
FIG. 2 is a section on the line II—II of FIG. 1.
Figure 3:
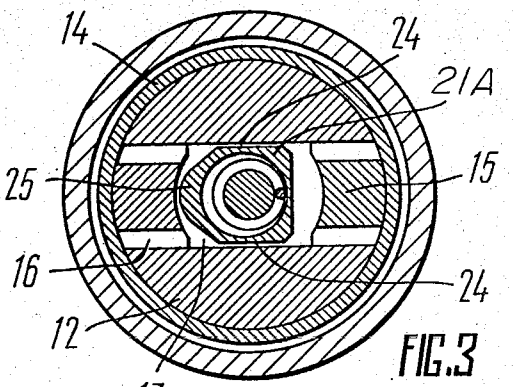
FIG. 3 is a section on the line III—III of FIG. 1.

(FIGS. 1 to 3), the body being fitted in a shroud 14. Hammer impact jaws 15 (FIGS. 1, 3) are made integral with flyweights 16 (FIGS. 1 to 3) which are made in the form of rectangular-section bars having bevelled edges 17 and installed in the recesses 13 in the flywheel mass 10. The flyweights 16 bear against bevelled surfaces 18 provided in the body 12 of the flywheel mass 10. A guide sleeve 19 (FIGS. 1, 2) having radial holes 20 is freely mounted on the drive shaft 6. The flyweights 16 have projections 21 which fit into the holes 20 in the guide sleeve 19 so that the flyweights 16 move simultaneously in an axial direction.

Figure 1:
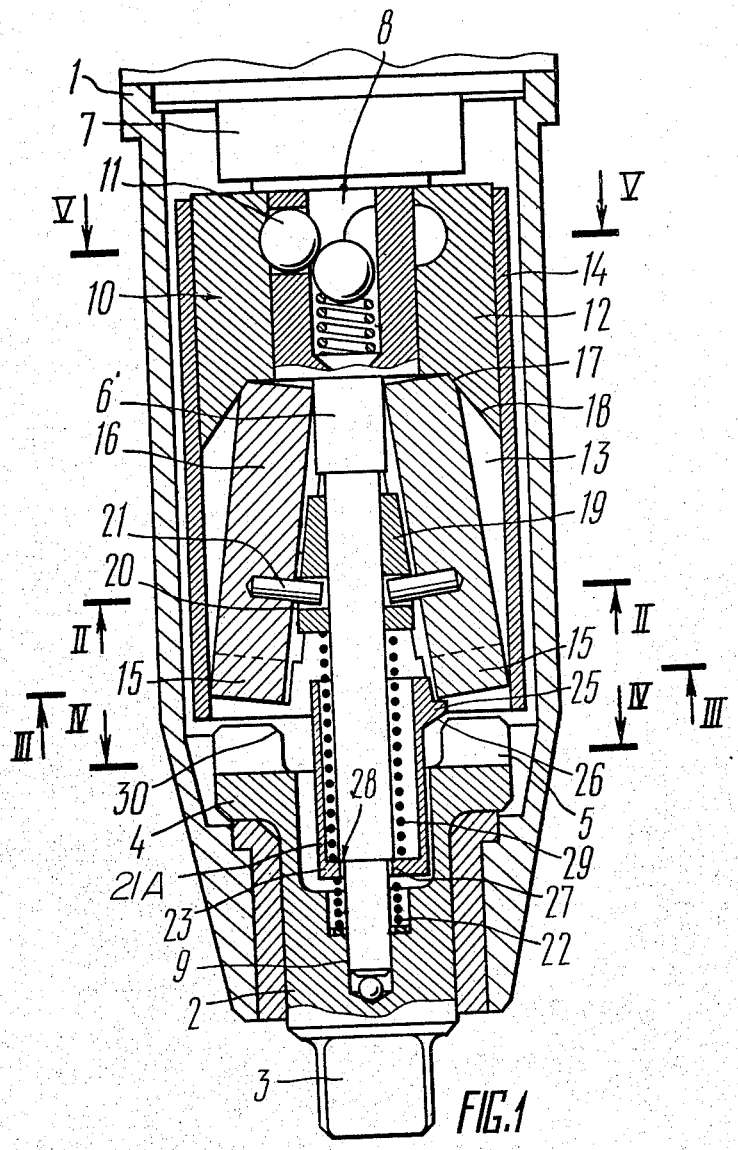
FIG. 1 is a longitudinal part-sectional view of the striking mechanism of the impact wrench according to the invention.

The flyweights 16 are mounted so that they can move freely in an axial direction in relation to the hammer flywheel mass 10. The axial movement of the flyweights is limited by an abutment installed between the hammer impact jaws 15 and the anvil 4. Referring to FIG. 1, the abutment is made in the form of a tiltable sleeve 21A mounted on the drive shaft 6 so that it can be tilted in the plane passing through the axis of the drive shaft 6, and a spring 22 fitted between the end wall 23 of the tiltable sleeve 21A and the anvil 4. The tiltable sleeve 21A (FIG. 3) has opposite flats 24 (FIG. 3) arranged to interact with the walls of the recess 13 in the body 12 of the flywheel mass 10 so that the tiltable sleeve 21A rotates together with the hammer impact jaws 15. The tiltable sleeve 21A has an external projection 25 with a bevelled surface 26 facing the anvil 4. The projection 25 (FIG. 3) is located in the plane parallel to the flats 24, due to which the projection 25 lies in the plane passing through the hammer impact jaws. The end wall 23 of the tiltable sleeve 21A has an eccentric hole 27 (FIGS. 1, 4) the diameter of which corresponds to the diameter of the drive shaft 6, the hole being eccentric in the plane passing through the external projection 25 provided on the tiltable sleeve 21A. The drive shaft 6 has a projection 28 for the end wall 23 of the tiltable sleeve 21A to bear thereagainst.

The distance from the axis of the drive shaft 6 to the outer edge of the projection 25 on the tiltable sleeve 21A is greater than the distance from the axis of the drive shaft 6 to the inner edge of the hammer impact jaws 15, due to which one of the impact jaws 15 bears against the projection 25 so that the abutment (the tiltable sleeve 21A and the spring 22) is in engagement with the impact cam 15 and limits the axial movement of the impact jaws 15 without interference which is an important feature of the present invention.

A return spring 29 is located inside the tiltable sleeve 21A between the end wall 23 thereof and the guide sleeve 19.

The impact jaws 5 of the anvil 4 have surfaces 30 designed to interact with the bevelled surface 26 of the projection 25 on the tiltable sleeve 21A.

Figure 6:
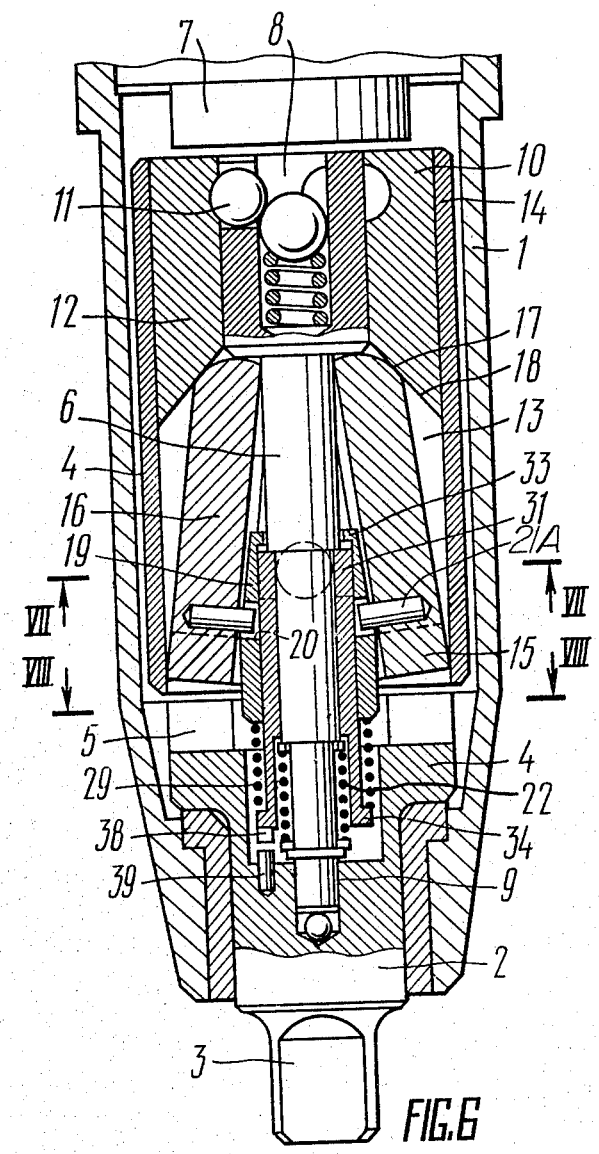
FIG. 6 is a longitudinal part-sectional view of the second embodiment of the impact wrench according to the invention.
Figure 7:
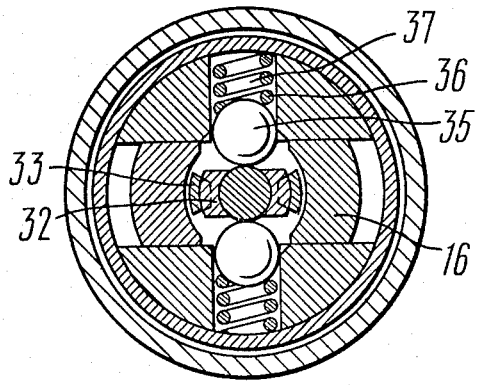
FIG. 7 is a section on the line VII—VII of FIG. 6.
Figure 8:
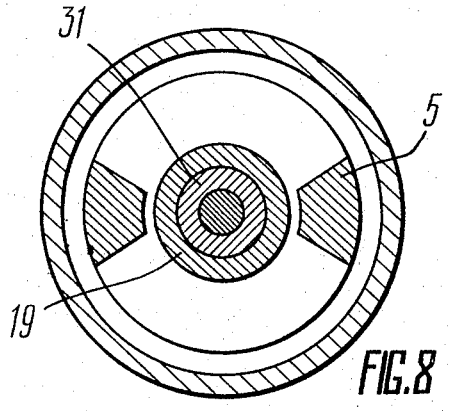
FIG. 8 is a section on the line VIII—VIII of FIG. 6.

The embodiment depicted in FIGS. 6 to 8, wherein like parts are designated by like numerals, differs in that the abutment is made in the form of a rotatable sleeve 31 (FIGS. 6, 8) installed between the drive shaft 6 and the guide sleeve 19. One end of the rotatable sleeve 31 has projections 32 (FIG. 7) arranged to interact with internal radial projections 33 (FIGS. 6, 7) provided in the guide sleeve 19. The rotatable sleeve 31 has a flange 34 (FIG. 6). The return spring 29 is installed between the flange 34 of the sleeve 31 and the guide sleeve 19. Rotation of the sleeve 31 together with the hammer impact jaws 15 is effected through balls 35 fitted in radial holes 36 in the body 12 of the striker flywheel mass 10 and loaded by springs 37 (FIGS. 6, 7).

The flange 34 of the rotatable sleeve 31 has an end cam 38 located in the plane passing through the end projections 32 on the sleeve 31. Rigidly secured in the anvil 4 is a pin 39 located in the plane passing through the impact jaws 5 of the anvil 4 and designed to interact with the end cam 38 on the rotatable sleeve 31. The rotatable sleeve 31 is located so that its end projections 32 and cam 38 are in the plane passing through the hammer impact cams 15.

Figure 9:
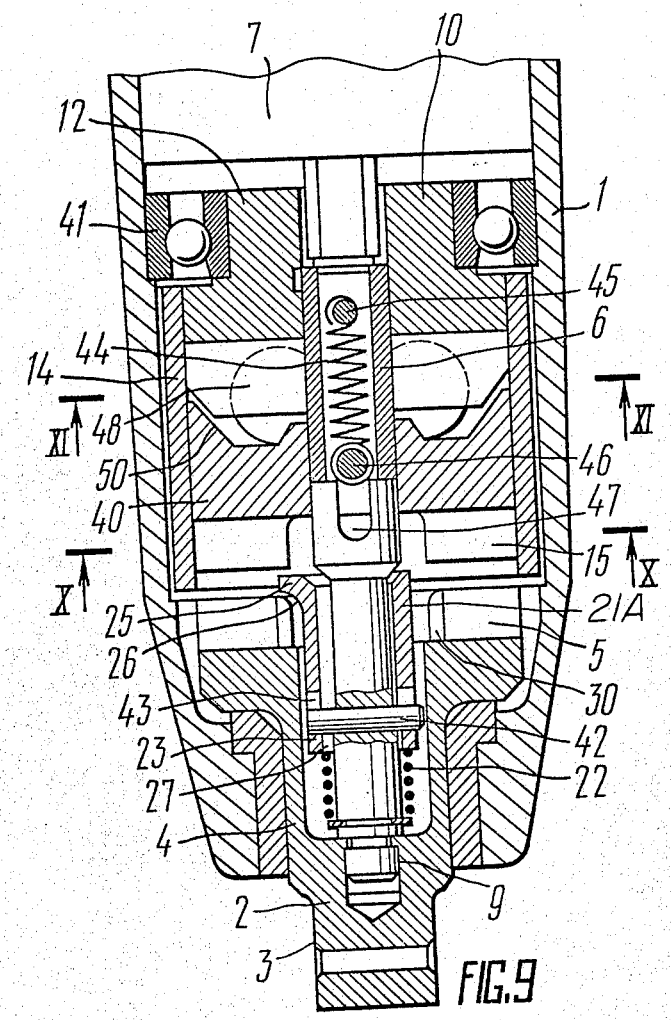
FIG. 9 is a longitudinal sectional view of the third embodiment of the impact wrench according to the invention.

In the embodiment depicted in FIG. 9, wherein like parts are designated by like numerals, the impact wrench has an abutment constructed in the form of the tiltable sleeve 21A similar to that used in the embodiment depicted in FIG. 1.

In this embodiment of the invention, the hammer impact jaws 15 are located on the hammer driven portion 40 installed in the shroud 14 of the flywheel mass 10. The external side surface of the hammer driven portion 40 and the internal surface of the shroud 14 have flats (FIG. 10) which enable the hammer driven portion 40 to rotate together with the flywheel mass 10 and move axially in relation thereto. The flywheel mass 10 is fixed axially by a press-fitted bearing 41 which supports the flywheel mass 10 in the housing 1. Rotation of the flywheel mass 10 is effected through connection thereof to the drive shaft 6.

The tiltable sleeve 21A rotates in synchronism with the hammer impact cams 15 due to provision of a pin 42 which is installed in a diametrical hole in the drive shaft 6 and fits into diametrically opposite lengthwise slots 43 provided in the tiltable sleeve 21A. The provision of the lengthwise slots 43 enables the sleeve 21A to move axially.

An extension return spring 44 is mounted between a pin 45 installed in the body 12 of the hammer flywheel mass 10 and a pin 46 secured in the hammer driven portion 40. To enable the hammer driven portion to move axially, the drive shaft 6 is provided with a longitudinal groove 47. The return spring can also be installed between the hammer driven portion and the anvil.

The flyweights are made in the form of balls 48 (FIGS. 9, 11) fitted in pairs in longitudinal recesses 13 (FIG. 11) which are formed between the walls of the body 12 of the hammer flywheel mass 10 and partitions 49. The hammer driven portion 40 has bevelled surfaces 50 for interaction with the balls 48 during hammer rotation.

In the embodiment of the invention depicted in FIGS. 12 to 15, wherein like parts are designated by like numerals, the tiltable sleeve 21A employed in the abutment is installed at an angle to the axis of the drive shaft 6 and provided with external projections 25. The sleeve 21A is set in a tilted position by a bevelled surface 51 provided on the drive shaft 6. When the sleeve 21A is moved by the spring 22, the bevelled surface 51 tilts the sleeve 21A in relation to the shaft 6 so that one of the projections 26 fits against the hammer driven portion 40. The sleeve can also be tilted by other means, for example, by the use of a spring-loaded ball fitted in the drive shaft (not shown).

The sleeve 21A is enabled to rotate together with the hammer impact cams 15 by provision of flats 52 on the drive shaft 6 and also by provision of a hole 53 with an appropriately shaped cross section in sleeve 51.

A return spring 54 is fitted between the pin 46 and a pin 55 installed in the anvil 5.

The impact wrench depicted in FIGS. 1 to 5 operates as follows:

A socket (not shown) is put on the square end 3 of the spindle 2 and applied to a fastener to be tightened. When the drive motor 7 is put in operation, the rotation of the drive shaft 6 is transmitted to the body 12 of the hammer flywheel mass 10 (FIG. 1) through the balls 11. During the rotation of the flywheel mass 10 the upper ends of the flyweights 16 move radially outward, their bevelled surfaces 17 engaging with the bevelled surfaces 18 on the body 12 of the flywheel mass 10. This engagement gives rise to an axial force which causes the flyweights 16 to move axially together with the hammer impact jaws 15, compressing the return spring 29. The hammer impact jaws 15 acts on the projection 25 of the tiltable sleeve 21A so that the latter moves toward the anvil 4, compressing the spring 22. When the flywheel mass 10 has gained a pre-set rotational speed, the bevelled surface 26 on the projection 25 of the tiltable sleeve 21A comes up against the surface 30 of one of the impact jaws 5 of the anvil 4, whereby the sleeve 21A is tilted in the plane passing through the axis of the drive shaft 6 and the projection 25 disengages from the hammer impact jaw 15. This allows the hammer impact jaws 15 to move further under the action of the flyweights 16 and engage the impact jaws 5 of the anvil 4. The striker impact cams 15 move simultaneously because they are interconnected by means of the guide sleeve 19. The kinetic energy accumulated by the flywheel mass 10 is transmitted to the anvil 4 and thence to the fastener being tightened.

After the impact the flywheel mass 10, which has stopped during the impact, does not rotate and the flyweights 16 are brought into the initial position by the return spring 29, whereas the spring 22 moves the tiltable sleeve 21A so that the sleeve projection 25 is again brought into engagement with the striker impact cam 15. Thereafter the cycle described above is repeated until the drive motor 7 is stopped.

It follows from the above description of the working process of the impact wrench constituting the invention that during the acceleration of the hammer only the hammer impact jaws 15 and the flyweights 16 move axially and a compression force is applied to the comparatively weak spring 22 and the return spring 29, whereas the flywheel mass 10 remains axially immobile.

The impact wrench depicted in FIGS. 6 to 8 works as described above, but the abutment, which in this embodiment comprises the rotatable sleeve 31, functions in another manner.

During the acceleration of the hammer flywheel mass 10 the rotatable sleeve 31 (FIG. 6) moves toward the anvil 4, compressing the spring 22. When the sleeve end cam 38 comes into engagement with the projection or pin 39 of the anvil 4, the rotatable sleeve 31 stops and its end projections 32 (FIG. 7) bear against the ball 35, to compress the spring 37. Since the guide sleeve 19 continues rotating, its internal radial projections 33 disengage from the end projections 32 of the rotatable sleeve 31, due to which the hammer impact jaws 15 freely move toward the anvil 4 and engage the impact jaws 5 thereof, the return spring 29 being compressed. The kinetic energy stored by the flywheel mass 10 is transmitted to the anvil 4 and thence to the fastener being tightened.

After the impact the guide sleeve 19 returns into the initial position together with the hammer impact jaws 15. At the same time the spring 22 moves the rotatable sleeve 31 toward the hammer flywheel mass 10, whereas the spring 37 and the balls 35 turn the sleeve 31 into the initial position so that the end projections 32 abut against the projections 33 of the guide sleeve 19. Thereafter the working cycle is repeated.

Figure 10:
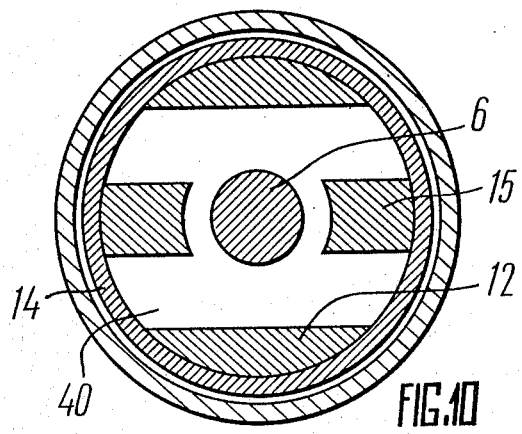
FIG. 10 is a section on the line X—X of FIG. 9.
Figure 11:
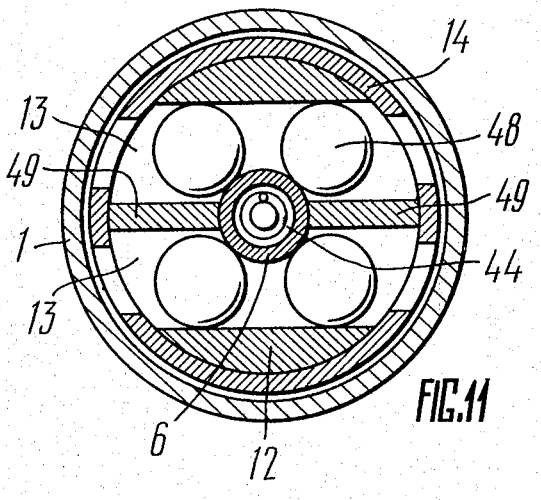
FIG. 11 is a section on the line XI—XI of FIG. 9.
Figure 12:
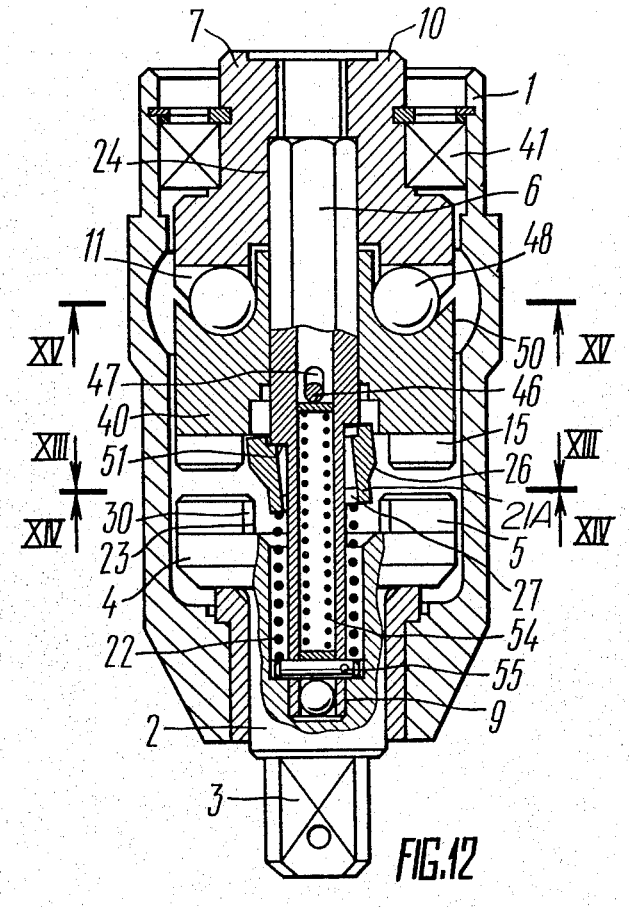
FIG. 12 is a longitudinal sectional view of the fourth embodiment of the impact wrench according to the invention.
Figure 14:
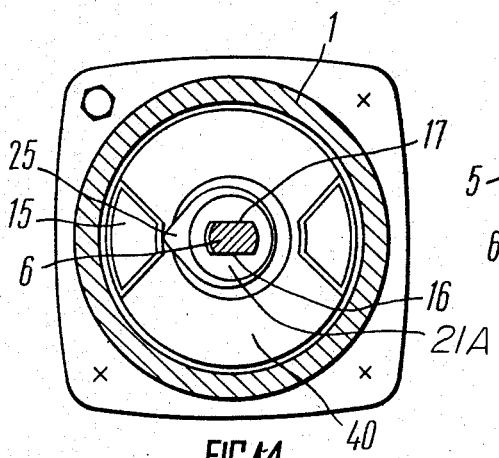
FIG. 14 is a section on the line XIV—XIV of FIG. 12.
Figure 13:
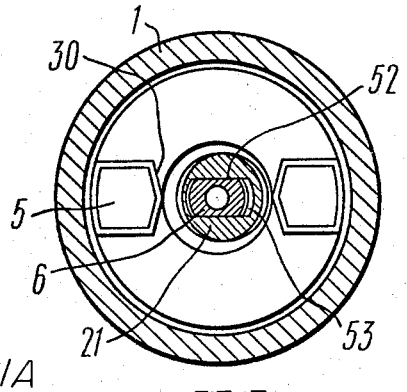
FIG. 13 is a section on the line XIII—XIII of FIG. 12.
Figure 15:
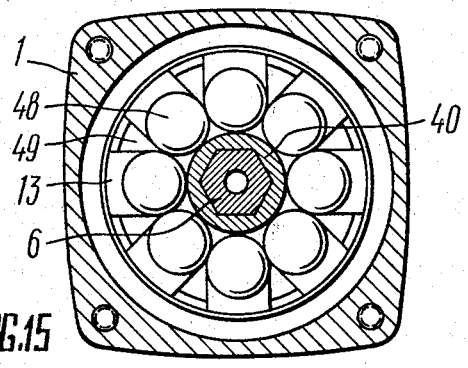
FIG. 15 is a section on the line XV—XV of FIG. 12.

In the embodiment of the invention depicted in FIGS. 9 to 11, during the rotation of the flywheel mass 10 the balls 48 move radially outward and act on the bevelled surfaces 50 of the hammer driven portion 40, moving it toward the anvil 4 and extending the spring 44. During the movement of the hammer driven portion 40 the impact jaw 15 (FIG. 9) thereof abuts against the projection 25 of the tiltable sleeve 21A and the latter moves together with the hammer drive portion 40 to compress the spring 22, until the bevelled surface 26 on the projection 25 of the sleeve 21A engages the surface 30 of one of the cams 5 of the anvil 4. When the surfaces 26 and 30 come into contact, the tiltable sleeve 21A tilts, releasing the hammer driven portion 40 for further movement, the hammer impact jaws 15 engage the impact cams 5 of the anvil 4 and an impact occurs. After the impact the return spring 44 contracts, returning the hammer driven portion 40 into the initial position, whereas the tiltable sleeve 21A is returned to the initial position by the spring 22. Thereafter the working cycle is repeated.

The embodiment of the impact wrench depicted in FIGS. 12 to 15 works essentially like the embodiment shown in FIGS. 9 to 11. The sleeve 21A is tilted in relation to the drive shaft 6 by interaction of the sleeve interior surface with the bevelled surface 51 of the drive shaft 6 during the movement of the sleeve 21A into the initial position under the action of the return spring 22.

What is claimed is:

1. An impact wrench comprising a housing; a drive motor accommodated in said housing and having a drive shaft; a spindle journalled in said housing; an anvil having impact jaws and rotatable together with said spindle; a hammer having a flywheel mass coupled to the drive shaft for combined rotation and impact jaws coupled to the flywheel mass for combined rotation and for relative axial movement during acceleration of the hammer, both said anvil and flywheel mass being fixed against axial movement; flyweights in said hammer for causing said impact jaws of said hammer to move toward said anvil for engagement with said impact jaws of said anvil; means provided between said impact jaws of said hammer and said anvil for preventing said impact jaws of said hammer from engaging said impact jaws of said anvil until said flywheel mass gains a predetermined rotational speed, said means preventing the engagement comprising an axially movable sleeve mounted on said drive shaft in such a manner that it is tiltable in the plane extending through the axis of said drive shaft between a first position in which said tiltable sleeve is in engagement with said impact jaws of said hammer and a second position in which said sleeve is disengaged from said impact jaws of said hammer, said tiltable sleeve being mounted for rotation together with said impact jaws of said hammer, said anvil having means engageable with said tiltable sleeve upon the movement of said tiltable sleeve toward said anvil together with said impact jaws of said hammer, whereby said sleeve is caused to tilt to said second position; and a spring between said tiltable sleeve and said anvil.

2. An impact wrench according to claim 1, wherein said tiltable sleeve has at least one radial projection in the plane extending through said impact jaws of said hammer, the distance from the axis of said drive shaft to the outer edge of said projection of said tiltable sleeve being greater than the distance from the axis of the drive shaft to the inner edge of said impact jaws of the hammer.

3. An impact wrench according to claim 2, wherein said tiltable sleeve has an end wall which faces said anvil and which is provided with an eccentric hole of a diameter corresponding to the diameter of said drive shaft, said hole being eccentric in the plane extending through said external projection of said tiltable sleeve and said end wall bearing against a shoulder provided on said drive shaft.

4. An impact wrench comprising a housing; a drive motor accommodated in said housing and having a drive shaft; a spindle journalled in said housing; an anvil having impact jaws and rotatable together with said spindle; a hammer having a flywheel mass coupled to said drive shaft for combined rotation and a drive part having bevel surfaces and impact jaws which is coupled to said flywheel mass for combined rotation and for relative axial movement toward said anvil during acceleration of said hammer, both said anvil and flywheel mass being fixed against axial movement; flywheights in said hammer, said flyweights comprising balls mounted for cooperation and with said bevel surfaces of said driven part of said hammer, whereby said driven part of said hammer is caused to move toward said anvil for engagement of said impact jaws of said hammer with said impact jaws of said anvil; means provided between said driven part of said hammer and said anvil for preventing said impact jaws of said hammer from engaging said impact jaws of said anvil until said hammer gains a predetermined rotation speed, said means preventing the engagement comprising an axially movable sleeve mounted on said drive shaft in such a manner that it is tiltable in the plane extending through the axis of said drive shaft between a first position in which said sleeve is in engagement with said driven part of said hammer and a second position in which said sleeve is disengaged from said driven part of said hammer, said tiltable sleeve being mounted for rotation together with said driven part of said hammer, said anvil having means engageable with said tiltable sleeve upon its movement toward said anvil together with said driven part of said hammer, whereby said sleeve is caused to tilt to said second position; a spring between said tiltable sleeve and said anvil; and a spring between said driven part of said hammer and said flywheel mass.

5. An impact wrench according to claim 4, wherein said tiltable sleeve has at least one radial projection in the plane extending through said impact jaws of said hammer, the distance from the axis of said drive shaft to the outer edge of said projection of said tiltable sleeve being greater than the distance from the axis of said drive shaft to the inner edge of said impact jaws of said hammer.

6. An impact wrench according to claim 5, wherein said tiltable sleeve is installed at an angle to the axis of said drive shaft, a tilting means being provided for setting said tiltable sleeve in a tilted position before said flywheel mass of said hammer is accelerated.

7. An impact wrench according to claim 6, wherein said tilting means comprises a bevel surface provided on said drive shaft.

8. An impact wrench comprising a housing; a drive motor accommodated in said housing and having a drive shaft; a spindle journalled in said housing; an anvil having impact jaws and rotatable together with said spindle; a hammer having a flywheel mass coupled to said drive shaft for combined rotation and impact jaws coupled to said flywheel mass for combined rotation and for relative axial movement during acceleration of said hammer, both said anvil and flywheel mass being fixed against axial movement; flyweights in said hammer for causing said impact jaws of said hammer to move toward said anvil for engagement with said impact jaws of said anvil, said flyweights being integral with said impact jaws of said hammer; a guide sleeve mounted on said drive shaft, said flyweights being coupled to said guide sleeve; means provided between said impact jaws of said hammer and said anvil for preventing said impact jaws of said hammer from engaging said impact jaws of said anvil until said flywheel mass gains a predetermined rotational speed, said means preventing the engagement comprising an axially movable rotatable sleeve having an end cam provided at the end face thereof facing said anvil and end projections provided at the opposite end, said guide sleeve having radial projections, said radial projections being engageable with said end projections of said rotatable sleeve, said rotatable sleeve being mounted for rotation together with said impact jaws of said hammer and for rotation relative to said guide sleeve between a first position in which said end projections of said rotatable sleeve engage said radial projections of said guide sleeve and a second position in which said end projections of said rotatable sleeve are disengaged from said radial projections of the guide sleeve; a yieldable means for fixing said rotatable sleeve against rotation relative to said guide sleeve, said anvil having an end projection engageable with said end cam of said rotatable sleeve upon said axial movement of said rotatable sleeve together with said impact jaws of said hammer toward said anvil, whereby said rotatable sleeve is caused to overcome the resistance of said yieldable means and to rotate to said second position, and a spring between said rotatable sleeve and said guide sleeve.

9. An impact wrench according to claim 8, wherein said yieldable means comprises spring-loaded balls accommodated in said flywheel mass opposite to said end projections of said rotatable sleeve.

10. An impact wrench comprising: a housing, a drive motor accommodated in said housing and having a drive shaft; a spindle journalled in said housing; an anvil having impact jaws and rotatable together with said spindle; a hammer having a flywheel mass coupled to said drive shaft for combined rotation and impact jaws coupled to said flywheel mass for combined rotation and for relative axial movement during acceleration of said hmmer; both said anvil and flywheel mass being fixed against axial movement; flyweights in said hammer for causing said impact jaws of said hammer to move toward said anvil for engagement with said impact jaws of the anvil, said flyweights being integral with said impact jaws of said hammer; a guide sleeve mounted on said drive shaft, said flyweights being coupled to said guide sleeve; means provided between said impact jaws of said hammer and said anvil for preventing said impact jaws of said hammer from engaging said impact jaws of said anvil until said flywheel mass gains a predetermined rotational speed, said means preventing the engagement comprising an axially movable sleeve mounted on said drive shaft for combined rotation with said impact jaws of said hammer; said sleeve being provided with an external radial projection which has a bevel surface and extends in the plane drawn through said impact jaws of said hammer, the distance from the axis of said drive shaft to the outer edge of said radial projection being greater than the distance from the axis of said drive shaft to the inner edge of said impact jaws of said hammer, and having an end wall which faces said anvil and has an eccentric hole of a diameter corresponding to the diameter of said drive shaft, said hole being eccentric in the plane extending through said radial projection of said sleeve, said drive shaft having a shoulder, and said end wall of said sleeve bearing against said shoulder of said drive shaft, said impact jaws of said anvil having at least one bevel surface, said sleeve being movable during acceleration of said flywheel mass of said hammer between a first position in which said radial projection is in engagement with said impact jaws of said hammer and prevents them from engaging said impact jaws of said anvil until said flywheel mass gains a predetermined rotational speed, and a second position to which said sleeve is tilted and in which said radial projection is disengaged from said impact jaws of said hammer upon engagement of said bevel surfaces of said radial projection with said bevel surfaces of said impact jaws of said anvil; a spring between said guide sleeve and said tiltable sleeve; and a spring between said tiltable sleeve and said anvil.

* * * * *